United States Patent [19]

Freeman

[11] Patent Number: 4,628,890

[45] Date of Patent: Dec. 16, 1986

[54] FUEL ATOMIZER

[76] Inventor: Winifer W. Freeman, 117 W. Mt. Vernon, Somerset, Ky. 42501

[21] Appl. No.: 645,869

[22] Filed: Aug. 31, 1984

[51] Int. Cl.[4] ..... F02M 29/04

[52] U.S. Cl. ..... 123/593; 123/590

[58] Field of Search ..... 123/590, 593; 48/189.4, 48/180.1

[56] References Cited

U.S. PATENT DOCUMENTS

| | | | |
|---|---|---|---|
| 1,473,349 | 11/1923 | Kach | 48/189.4 |
| 1,503,371 | 7/1924 | Meyer | 48/189.4 |
| 1,515,408 | 11/1924 | Puffer | 123/590 |
| 1,683,281 | 9/1928 | Asire | 123/590 |
| 1,727,045 | 9/1929 | Asire | 123/590 |
| 2,032,548 | 3/1936 | Miller | 48/180 R |
| 2,251,371 | 8/1941 | Moyer . | |
| 2,715,648 | 8/1955 | Sachsse et al. | 48/180 R |
| 2,925,257 | 2/1960 | Cohn . | |
| 3,064,680 | 11/1962 | Winslow | 48/180 R |
| 3,091,229 | 5/1963 | Nevin | 123/590 |
| 3,449,098 | 6/1969 | Larson . | |
| 3,458,297 | 7/1969 | Anderson | 123/590 |
| 3,459,162 | 8/1969 | Burwinkle . | |
| 3,918,423 | 11/1975 | Amor | 123/590 |
| 3,998,195 | 12/1976 | Scott | 123/590 |
| 4,078,532 | 3/1978 | Smith . | |
| 4,092,966 | 6/1978 | Prosen | 123/590 |
| 4,094,290 | 6/1978 | Dismuke . | |
| 4,153,028 | 5/1979 | Kumm . | |
| 4,215,663 | 8/1980 | Gaylord . | |

FOREIGN PATENT DOCUMENTS

| | | | |
|---|---|---|---|
| 1063457 | 10/1979 | Canada | 48/189.4 |
| 657662 | 5/1929 | France | 48/189.4 |
| 991020 | 9/1951 | France | 123/590 |

*Primary Examiner*—Ronald H. Lazarus

*Attorney, Agent, or Firm*—King & Schickli

[57] ABSTRACT

A plate having a plurality of apertures through which a fuel-air mixture travels is positioned between a fuel injector, such as a carburetor, and an intake manifold of an internal combustion engine. The apertures taper outwardly toward the intake manifold from a restricted orifice area adjacent the fuel injector. The taper of the apertures allows the fuel-air mixture to expand and provides better atomization of the fuel. The size and shape of the apertures is such as to cause ultrasonic sound and reverberation which is a phenomena that helps break up the droplets of fuel into minute droplets. The preferred embodiment includes a ratio of the restricted aperture area in the plate to the total displacement of the engine from 0.006 to 0.012, with the optimum ratio being approximately 0.007. The inside surface of the tapered apertures includes longitudinal flutes extending from the upper to the lower surface of the plate. The longitudinal flutes allow better attachment of the air molecules to the surface of the apertures and prevents swirling or rotation of the fuel-air mixture. The atomizer provides highly improved fuel economy and a lowering of noxious emissions. A mask element is provided to limit the air-fuel mixture to a predetermined pattern, and openings around the pattern limit heat transfer to the air-fuel mixture.

10 Claims, 6 Drawing Figures

FUEL ATOMIZER

TECHNICAL FIELD

The invention relates generally to internal combustion engines and more particularly to the atomizing of liquid fuel entrained in a fuel-air mixture for improved fuel combustion within the engine.

BACKGROUND OF THE INVENTION

In a typical internal combustion engine, supply air is drawn from the atmosphere through an intake passageway which includes a fuel injector, such as a carburetor. The fuel injector supplies and intermixes metered quantities of liquid fuel with the supply air, and the resulting mixture is then drawn through an intake manifold to one or more cylinders for combustion. The carburetor, or other type of fuel injector, is designed to atomize the liquid fuel or, in other words, to break up streams of the liquid fuel into very small droplets for dispersal into the supply air. However, it is generally recognized that existing fuel injectors are not totally effective in atomizing liquid fuel and mixing it with the supply air. Incomplete fuel atomization and inadequate dispersal of the fuel drops into the supply air results in incomplete fuel combustion and reduced engine efficiency. Further, and perhaps of even greater contemporary concern, incomplete fuel combustion also results in the release of harmful, unburnt hydrocarbons and other noxious gases into the atmosphere through the engine exhaust.

A number of different devices in the prior art have been positioned in internal combustion engines between the carburetor and the intake manifold to more fully atomize the fuel and to more thoroughly intermix it with the supply air. Many of these prior art devices have been designed to swirl the supply air for enhanced intermixture. For example, in U.S. Pat. No. 4,153,028 to Kumm et al, a cylindrical rotor is used to "chop" the fuel-air mixture for greater atomization and improved dispersal. Another device for creating a swirling vortex in the fuel-air mixture is disclosed in U.S. Pat. No. 2,251,371 to Moyer, wherein supplemental fuel is tangentially added to a rotating vortex of supply air in a converging mixing passageway.

A somewhat different approach is taken in U.S. Pat. No. 2,925,257 to Cohn, wherein increased atomization of the fuel is attempted by directing the fuel-air mixture through a multiplicity of low pressure zones. These low pressure zones are formed by a corresponding multiplicity of venturi shaped apertures. Openings leading to a fuel supply are provided in each of the venturi shaped apertures to permit introduction of additional fuel into each of the low pressure zones.

Several other attempts have been made in the prior art to atomize fuel entrained in an fuel-air mixture with screen-like devices interposed in the intake system between the fuel injector and the intake manifold. For example, in U.S. Pat. No. 3,449,098 to Larson, a screen is positioned in an intake passageway immediately beneath a butterfly throttle valve. The screen has a semispherical shape to accommodate pivotal movement of the butterfly valve. In U.S. Pat. No. 4,094,290 to Dismuke, a plurality of screens are positioned between a carburetor and an intake manifold of an internal combustion engine. A plurality of balls are then encaged between the screens to provide a whirling effect in the fuel-air mixture.

A screen-like arrangement formed by a stack of aluminum plates having registered apertures are disclosed in U.S. Pat. no. 3,459,162 to Burwinkle. Burwinkle also provides a serpentine passage which extends transversely through the plates for directing heated air to preheat the fuel-air mixture for improved vaporization. A further screen-like member interposed between a carburetor and an intake manifold for heating the fuel-air mixture are disclosed in U.S. Pat. No. 4,078,532 to Smith. In this last mentioned patent, the screen-like member is in the form of a plate having a plurality of indentations on its leading face. The indentations functions as reservoirs for accumulating and heating unvaporized liquid fuel. The Smith plate is conductively heated by the heat of the intake manifold to complete fuel vaporization of the accumulated liquid.

A still further structure for intermixing an fuel-air mixture is disclosed in U.S. Pat. No. 4,215,663 to Gaylord. The Gaylord device includes a spacer having a passageway aligned with the intake system passageway. The sidewalls of the passageway have a plurality of recesses for trapping vortices of fluid as the fuel-air mixture flows through the intake system.

Despite the numerous attempts to solve the above mentioned problems, fully satisfactory solutions for fuel atomization have not been found in the prior art. Many of the prior attempts have, in fact, been counterproductive. Preheating the fuel-air mixture in the intake passage upstream of the intake manifold, for example, tends to cause premature detonation of the fuel. Many of the other attempts have proved to be ineffective or unreliable in operation.

SUMMARY OF THE INVENTION

Accordingly, it is a primary object of the invention to provide a fuel atomizer which more fully atomizes liquid fuel.

It is another object of the invention to provide a fuel atomizer producing improved dispersal of very small fuel droplets into a quantity of supply air.

A further object of the invention is to reduce the level of hydrocarbons and carbon monoxide in the exhaust of an internal combustion engine with a fuel atomizer positioned in an intake passage between a fuel injector and an intake manifold.

Yet another object of the present invention is to prevent swirling of the fuel-air mixture with a fuel atomizer positioned upstream of the intake manifold in an internal combustion engine.

A still further object of the invention is to provide a fuel atomizer in the intake system of an internal combustion engine having means for reducing conductive heat transfer to the atomizer so as to avoid heating of the fuel-air mixture.

It is yet another object of the invention to provide an improved fuel atomizer which may be retrofitted to an existing internal combustion engine without altering standard engine equipment.

Additional objects, advantages and other novel features of the invention will be set forth in part in the description that follows and in part will become apparent to those skilled in the art upon examination of the following, or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved fuel atomizer is provided for attachment to an internal combustion engine with a fuel injector and an intake manifold. The atomizer provides atomization and dispersal of liquid fuel droplets entrained in a fuel-air mixture and includes a plate having a first surface adjacent the injector and a second surface adjacent the intake manifold. The plate member has a plurality of apertures, with each of the apertures having walls with longitudinal fluting extending in a direction from the first surface to the second surface of the plate. The atomizer minimizes swirling of the fuel-air mixture through the apertures and enhances atomization by droplet explosion prior to combustion.

In another aspect of the invention, the apertures taper outwardly from a restricted orifice area at the first surface adjacent the fuel injector to a second surface adjacent the intake manifold. This tapering produces a low pressure area to enhance the droplet explosion effect.

In one preferred form of the invention, the taper of the apertures is approximately 15°.

According to another aspect of the invention, the ratio of the area provided by the apertures in the plate, in square inches, to the total displacement of the engine, in cubic inches, is from 0.006 to 0.012.

In a specific aspect of the invention, the ratio of the aperture area opening, in square inches, to engine displacement, in cubic inches, is approximately 0.007.

In another aspect of the invention, the ratio of aperture area in the plate to the total displacement of the engine is sufficient to accelerate the fuel-air mixture so as to generate ultrasonic sound and reverberation in the apertures to further break up the fuel droplets.

In another specific aspect of the invention, the fuel injector is a carburetor.

A gasket is provided between the manifold and the plate to provide heat insulation from the engine to reduce heating of a fuel-air mixture passing through the atomizer in another aspect of the invention.

In yet another aspect of the invention, a mask element is provided between the fuel injector and the plate to limit flow of the fuel-air mixture to a predefined pattern of the apertures.

In another aspect of the invention, openings are provided in the plate outside the predefined pattern to limit conductive heat transfer from the periphery of the plate to the fuel-air mixture passing through the apertures. In this way, the fuel-air mixture remains cool, and premature fuel detonation is prevented.

In still another and specific aspect of the invention, the thickness of the plate is approximately 3/16 inch.

According to a further aspect of the invention, a fuel atomizer is provided for attachment to an internal combustion engine between a fuel injector and an intake manifold to promote atomization of liquid fuel droplets in a fuel-air mixture for combustion. The atomizer includes a plate having a plurality of openings extending therethrough and a gasket between the manifold and the plate to provide heat insulation from the engine. A mask element is positioned between the fuel injector and the plate to limit flow of the fuel-air mixture to a predefined pattern of the apertures. Openings are also provided in the plate outside the predefined pattern to limit heat transfer from the periphery of the plate to the fuel-air mixture passing through the apertures, whereby the fuel-air mixture remains cool, and premature fuel detonation is prevented.

Still other objects of the present invention will become apparent to those skilled in this art from the following description wherein there is shown and described a preferred embodiment of this invention, simply by way of illustration, of one of the best modes contemplated for carrying out the invention. As will be realized, the invention is capable of other different embodiments, and its several details are capable of modification in various, obvious aspects, all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
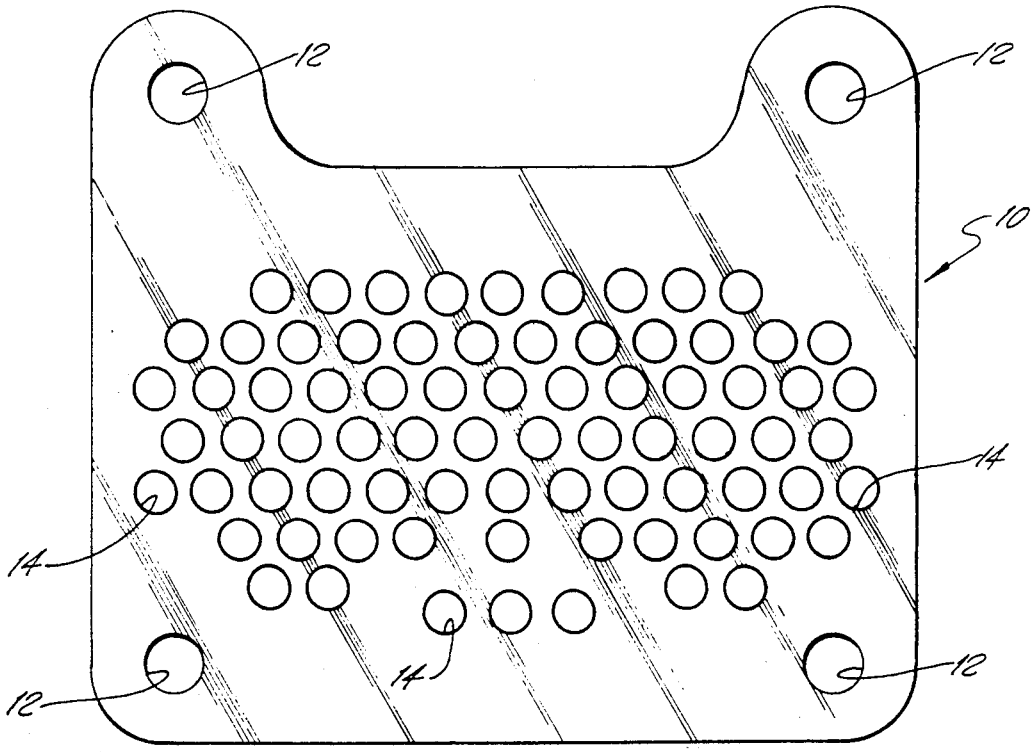
FIG. 1 is plan view of an apertured atomizing plate constructed in accordance with the present invention for atomizing liquid fuel droplets entrained in a fuel-air mixture passing therethrough.

Referring now to the drawings, FIG. 1 shows an atomizing plate 10 constructed in accordance with the invention for atomizing liquid fuel droplets entrained in a fuel-air mixture. The illustrated atomizing plate 10 has a generally rectangular shape, with bolt receiving apertures 12 at each of its respective corners. In addition, the atomizing plate 10 includes a plurality of spaced apertures 14 extending through a centrally disposed area of the plate 10. The atomizing plate 10, as described more fully hereinafter, is designed for disposition in the intake system of an internal combustion engine with the apertures 14 forming passageways for a fuel-air mixture being supplied to an intake manifold.

As will be apparent to those skilled in the art, the atomizing plate 10 may be formed from a number of suitable materials. However, for the reasons more fully set forth in the description that follows, the atomizing plate 10 is preferably formed of a material having a relatively low thermal conductivity. In the preferred form, the atomizing plate is formed of metal stock having a thickness of approximately 3/16 inches.

Figure 2:
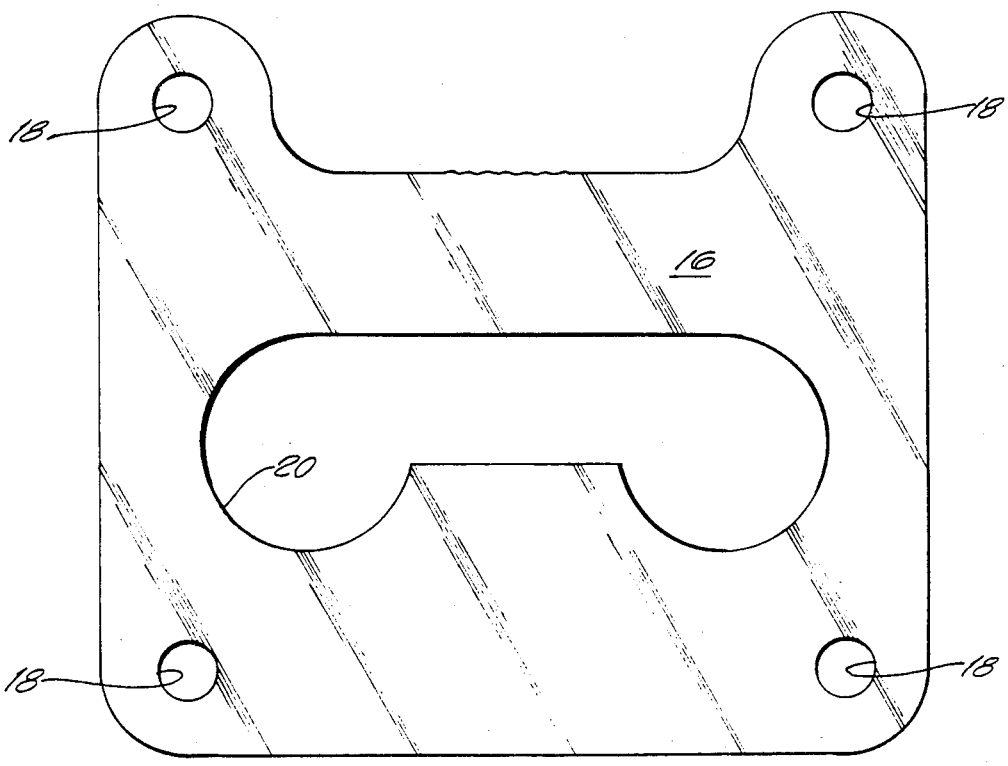
FIG. 2 is a plan view of a mask adapted for cooperative interfacing with the atomizing plate of FIG. 1.

FIG. 2 depicts a generally rectangular mask 16 for use with the atomizing plate 10 of FIG. 1. The mask 16, like the atomizing plate 10, has bolt receiving apertures in each of its corners, the mask apertures being identified by the numeral 18. Mask apertures 18 are spaced in correspondency to the apertures 12 of the atomizing plate 10, so as to permit the two sets of apertures 12,18 to be brought into registry to jointly receive four bolts 27 when the mask 16 and atomizing plate 10 are assembled (see FIG. 3).

The mask 16 also includes a centrally disposed fluid passageway 20. However, from a comparison of FIGS. 1 and 2, it may be observed that the centrally disposed fluid passageway 20 is smaller in area than the centrally apertured area of atomizing plate 10, and that the mask 16 limits fluid passage through the plate 10 to a predefined pattern of apertures 14. As a result of this disparity in areas, a portion of the apertures 14, outside the predefined pattern, are covered by the mask 16 when the bolt receiving apertures 12,18 of the plate and the mask 10,16 are brought into registry. In other words, a portion of the atomizing plate 10 beneath the mask 16 is interrupted by those apertures 14 located outside the area defined by the fluid passageway 20 This discontinuity in the atomizing plate 10 beneath the mask 16 reduces the thermal conduction path from the periphery of the atomizing plate 10 to the central area containing the apertures 14. As a result, the amount of heat transferred to the central area of plate 10 is reduced, and heating of the fuel-air mixture passing through the apertures 14 within passageway 20 is prevented.

Figure 3:
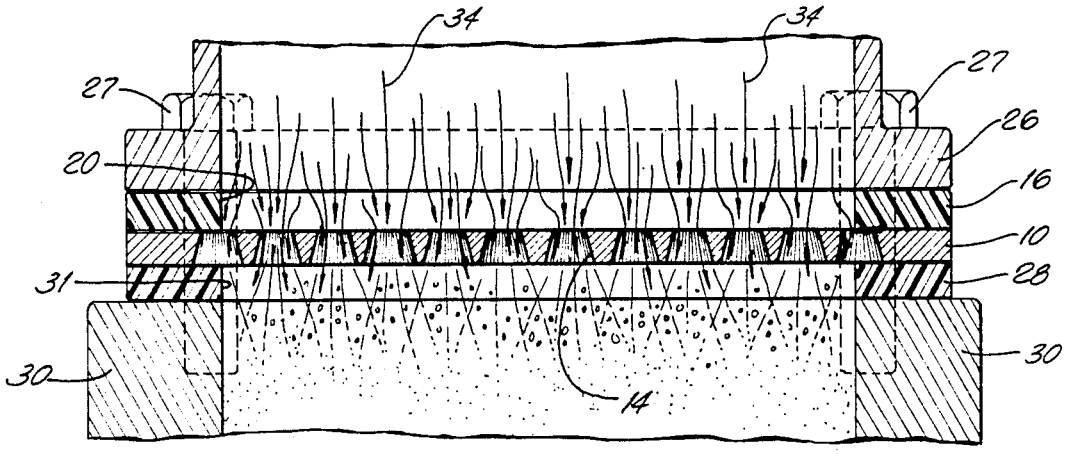
FIG. 3 is a cross-sectional elevational view of a fuel atomizer formed by the atomizing plate and mask of FIGS. 1 and 2 and positioned in operative relationship between a carburetor and an intake manifold of an internal combustion engine.
Figure 5:
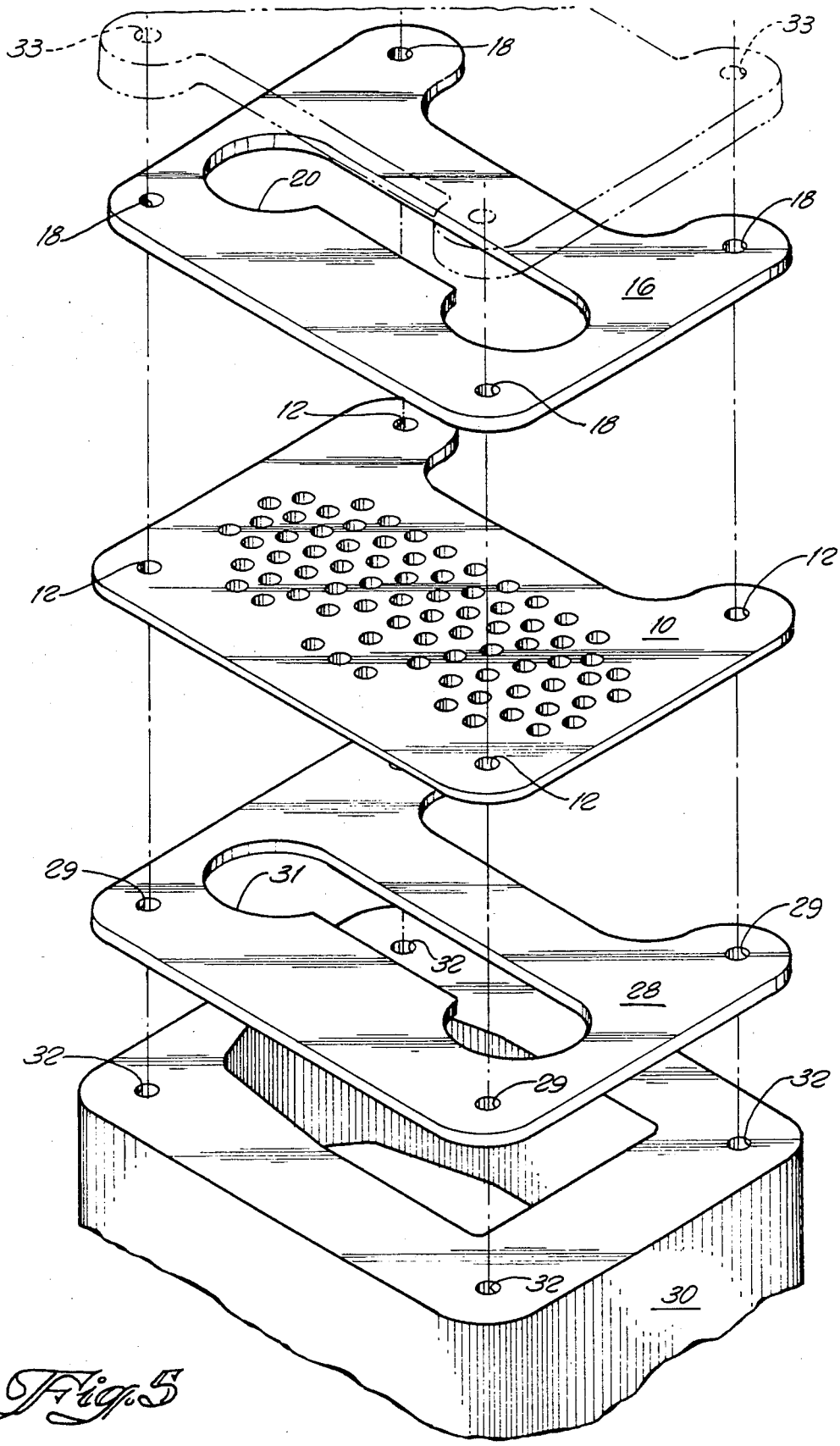
FIG. 5 is an exploded view of the fuel atomizer assembly of FIG. 3.

Turning now to FIGS. 3 and 5, it is seen that the unit formed by the atomizing plate 10 and mask 16 is positioned in the intake system of an internal combustion engine. In FIGS. 3 and 5, the mask 16 is shown adjacent to a base of a fuel injector 26, illustrated as a carburetor in the preferred embodiment (as used in the present specification and claims, the term "fuel injector" will be used to generically describe any fuel-air mixture devices, such as a carburetor). A gasket 28 is interposed between the atomizing plate 10 and an engine intake manifold 30. As perhaps most clearly seen in FIG. 5, the gasket 28 includes a centrally disposed passageway 31 to permit the passage of the fuel-air mixture into the intake manifold 30. The passageway 31 through gasket 28 is significantly larger than the passage 20 in mask 16, and the gasket 28 does not effectively limit the fluid passage area through atomizing plate 10. The gasket 28 and intake manifold 30 each have four spaced bolt receiving apertures, apertures 29 extending through gasket 28 and apertures 32 extending into the intake manifold 30. Apertures 29 and 32 are also spaced in correspondency with the apertures 12 of atomizing plate 10. These apertures are also aligned with a series of apertures 33 in the base of carburetor 26 so as to permit joining of the assembly with bolts 27, as shown in FIG. 3.

Figure 4:
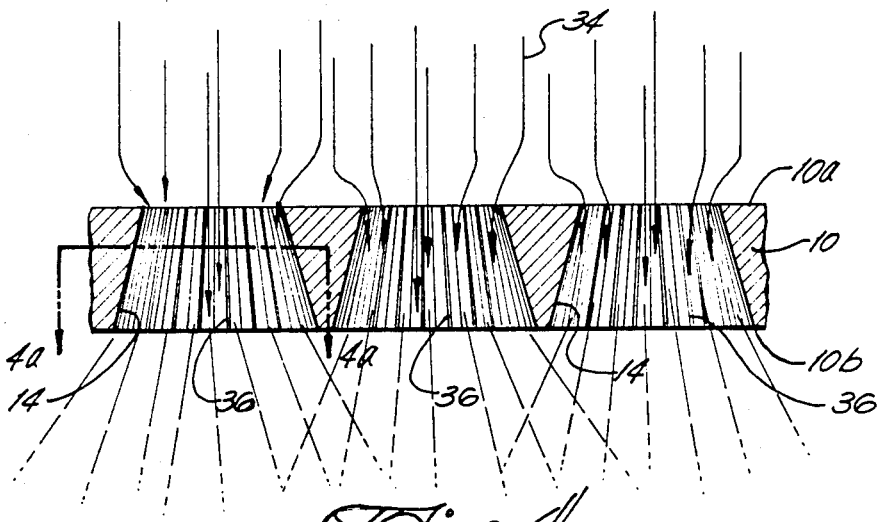
FIG. 4 is an enlarged fragmentary view, partially in cross-section, of the atomizing plate of FIG. 3 more clearly depicting a plurality of apertures extending therethrough.
Figure 4A:
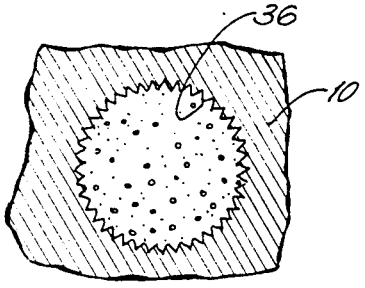
FIG. 4*a* is a cross-sectional view taken along line 4*a*—4*a* in FIG. 4 depicting one of the plurality of apertures for passage of the fuel-air mixture.

As suggested by arrows 34 in FIGS. 3 and 4, the fuel-air mixture passes downwardly from the carburetor 26 and through the fluid passageway 20 in the mask 16. In order to reach the intake manifold 30, and the cylinders located downstream thereof, the fuel-air mixture must pass through the apertures 14 in the atomizing plate 12 within the pattern defined by the fluid passageway 20.

It will be observed from FIG. 4 that the apertures 14 diverge in the direction of flow. In other words, apertures 14 taper outwardly from a restricted orifice at a first or top surface **10*a* of the atomizing plate 10, adjacent to the carburetor 26, to a slightly enlarged aperture at a second or bottom surface 10*b* of the atomizing plate 10, the second surface being adjacent to the intake manifold 30. In the preferred embodiment, this taper is approximately 15°. As a result of this outward taper, low pressure areas are provided within the apertures 14 and at the enlarged discharge locations of these apertures 14**.

It will be further noted from both FIGS. 4 and **4*a* that each of the apertures 14 has longitudinal fluting 36 extending from the first atomizing plate surface 10*a* to the second or bottom atomizing plate surface 10*b*. These longitudinal flutes 36 cut into the walls of the aperture 14. The longitudinal flutes 36 allow better attachment of the air molecules to the walls of aperture 14 which helps to establish straight through and expanding flow and prevent swirling or rotation of the fuel-air mixture (see FIG. 4**).

The above described aperture structure provides for ultrasonic reverberation of the fuel-air mixture during passage through the atomizing plate 10 whenever the displacement of the internal combustion engine is sufficient. Such reverberation effectively explodes liquid fuel droplets entrained within the fuel-air mixture into a fine mist of subdivided droplets, and further disperses the subdivided fuel droplets within the fuel-air mixture. The longitudinal flutes 36 enhance this ultrasonic explosive effect by minimizing swirling or rotation of the fuel-air mixture. The low pressure areas created by the outwardly tapered apertures 14 further enhance this explosive effect.

Applicants have further discovered that optimum performance of the above described fuel atomizer is obtained when the ratio of the area (in square inches) of the restricted portion of the aperture in the area defined by passageway 20 (at the first fuel atomizing plate surface **10*a*) to the engine displacement (in cubic inches) is between 0.00600 and 0.01200, with a ratio in the order of 0.007 being the most preferred. The illustrated embodiment has a restricted orifice area of approximately 2.22 square inches (approximately 40 of the orifices 14**, with each orifice having a diameter of approximately 17/64 inch) and is designed for use in a 318 cubic inch internal combustion engine. This particular combination of sizes produces an optimum aperture area/engine displacement ratio of approximately 0.06698.

As noted above, numerous attempts have been made in the prior art to heat fuel atomizers for the purpose of preheating the fuel-air mixture passing therethrough to promote fuel vaporization. However, applicant has found that such preheating may deleteriously produce premature detonation of the fuel (prespark detonation in a spark ignited engine). Hence, applicant most advantageously reduces heating of the atomizing plate 10, and hence, reduces heating of the fuel-air mixture passing therethrough. This is accomplished in the illustrated embodiment by using a gasket 28 formed of mold plastic or other material having a low rate of thermal conductivity. The insulation provided by the gasket 28 is coupled with the effects of the thermal barrier created by the discontinuities in the atomizing plate 10 (from the covered apertures 14) to minimize heat transfer between the intake manifold 30 and the atomizing plate 10.

In summary, numerous benefits have been described which result from employing the concepts of the invention. The fuel atomizer of the invention includes a plurality of apertures with longitudinal fluting for minimizing swirl or rotation of the fuel-air mixture, and promotes ultrasonic reverberation of fuel droplets entrained within this fuel-air mixture. The outwardly tapered apertures in the atomizing plate also produce low pressure areas within the apertures and near their discharge locations which promote and enhance the explosive effects of ultrasonic reverberation on any entrained fuel droplets. Thermally insulating the atomizer from the intake manifold also significantly reduces preheating of the fuel-air mixture passing through the atomizer and correspondingly reduces the chances of premature detonation of the fuel. Matching the area of the orifice openings in the atomizing plate to the displacement of the engine has also been found to optimize the effectiveness of the atomizer. An internal combustion engine using an atomizer constructed according to the invention has been found to start more easily and to operate more efficiently than a similar internal combustion engine without such an atomizer. Moreover, the exhaust from an engine using such a fuel atomizer has significantly reduced levels of unburned hydrocarbons, carbon monoxide and other noxious gases. Furthermore, the fuel atomizer of the invention is easily retrofitted to existing engines without alteration of standard equipment. Further, there are no moving parts and virtually no maintenance for the described atomizer.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

I claim:

1. A fuel atomizer for attachment to an internal combustion engine with a fuel injector and an intake manifold to provide atomization and dispersal of liquid fuel droplets entrained in an air-fuel mixture, comprising:

a plate having a first surface and a second surface, said plate including a plurality of apertures having walls with longitudinal fluting extending in a direction from said first surface to said second surface of said plate;

a mask element provided in direct contact with said first surface of said plate and disposed between said plate and said fuel injector to limit the fuel-air mixture to a predefined pattern of said apertures; and a gasket provided in direct contact with said second surface of said plate and disposed between said plate and said manifold to provide heat insulation from said engine;

whereby swirling of the fuel-air mixture through the apertures is minimized and atomization by droplet explosion prior to combustion is maximized.

2. A fuel atomizer for attachment to an internal combustion engine between a fuel injector and an intake manifold to provide a fuel-air mixture for combustion, comprising:

a plate including a plurality of apertures having walls with longitudinal fluting extending therethrough;

a gasket between said manifold and said plate to provide heat insulation from the engine; and a mask element between said fuel injector and said plate, said mask element including an opening smaller than the toal area of said plate to limit the fuel-air mixture to a predefined pattern of said apertures, apertures in said plate outside said predefined pattern formed by said opening in said mask element limiting heat transfer from the periphery of said plate to said fuel-air mixture passing through said apertures, whereby the mixture remains cool and premature fuel detonation is prevented.

3. The fuel atomizer of claim 1, wherein said apertures taper outwardly from a restricted orifice area at the first surface adjacent said injector to said second surface adjacent said intake manifold, whereby a low pressure area is produced to enhance the droplet explosion effect.

4. The fuel atomizer of claim 3, wherein the taper is approximately 15°.

5. The fuel atomizer of claim 1, wherein the ratio of the restricted aperture area in said plate, in square inches, to the total displacement of the engine, in cubic inches, is from 0.006 to 0.012.

6. The fuel atomizer of claim 5, wherein said ratio is approximately 0.007.

7. The fuel atomizer of claim 1, wherein the ratio of restricted aperture area in said plate to the total displacement of the engine is sufficient to accelerate said fuel-air mixture so as to generate ultrasonic sound and reverberation in said apertures to further break up the fuel droplets.

8. The fuel atomizer of claim 1, wherein said fuel injector is a carburetor.

9. The fuel atomizer of claim 1, wherein openings are provided in said plate outside said predefined pattern to limit heat transfer from the periphery of said plate to said fuel-air mixture passing through said apertures, whereby the mixture remains cool and premature fuel detonation is prevented.

10. The fuel atomizer of claim 1, wherein the thickness of said plate is approximately 3/16 inch.

* * * * *